United States Patent [19]

Klupt

[11] 4,002,288

[45] Jan. 11, 1977

[54] FOOD CONTAINER

[76] Inventor: Carle D. Klupt, 8218 Arrowhead Road, Baltimore, Md. 21208

[22] Filed: Apr. 21, 1976

[21] Appl. No.: 678,783

[52] U.S. Cl. ..... 229/39 R; 229/22; 229/8; 206/150

[51] Int. Cl.[2] ..... B65D 5/10

[58] Field of Search ..... 229/8, 39, 22, 16 B; 119/19, 23; D9/197, 180

[56] References Cited

UNITED STATES PATENTS

| | | | |
|---|---|---|---|
| 1,824,762 | 9/1931 | Bloom | 229/22 |
| 1,899,241 | 2/1933 | Marr | 229/8 X |
| 1,941,538 | 1/1934 | Costello | 229/8 X |
| 2,116,652 | 5/1938 | Adler | 229/39 R X |
| 2,134,971 | 11/1938 | Guyer | 229/8 X |
| 2,666,414 | 1/1954 | Burr et al. | 219/23 |
| 3,199,765 | 8/1965 | Locke | 229/22 X |
| 3,305,085 | 2/1967 | Rossi | 206/150 |
| 3,355,082 | 11/1967 | Wood | 229/16 B |
| 3,703,256 | 1/1972 | Ross | 229/39 R |

*Primary Examiner*—Davis T. Moorhead
*Attorney, Agent, or Firm*—Leitner, Palan & Martin

[57] ABSTRACT

A container formed from a one-piece blank where the end panels are divided by fold lines into three triangles. A pair of triangular slots in the top panel open at the respective lateral edges of the top panel to removably receive and lock the folded end panels.

13 Claims, 6 Drawing Figures

FIG. 1
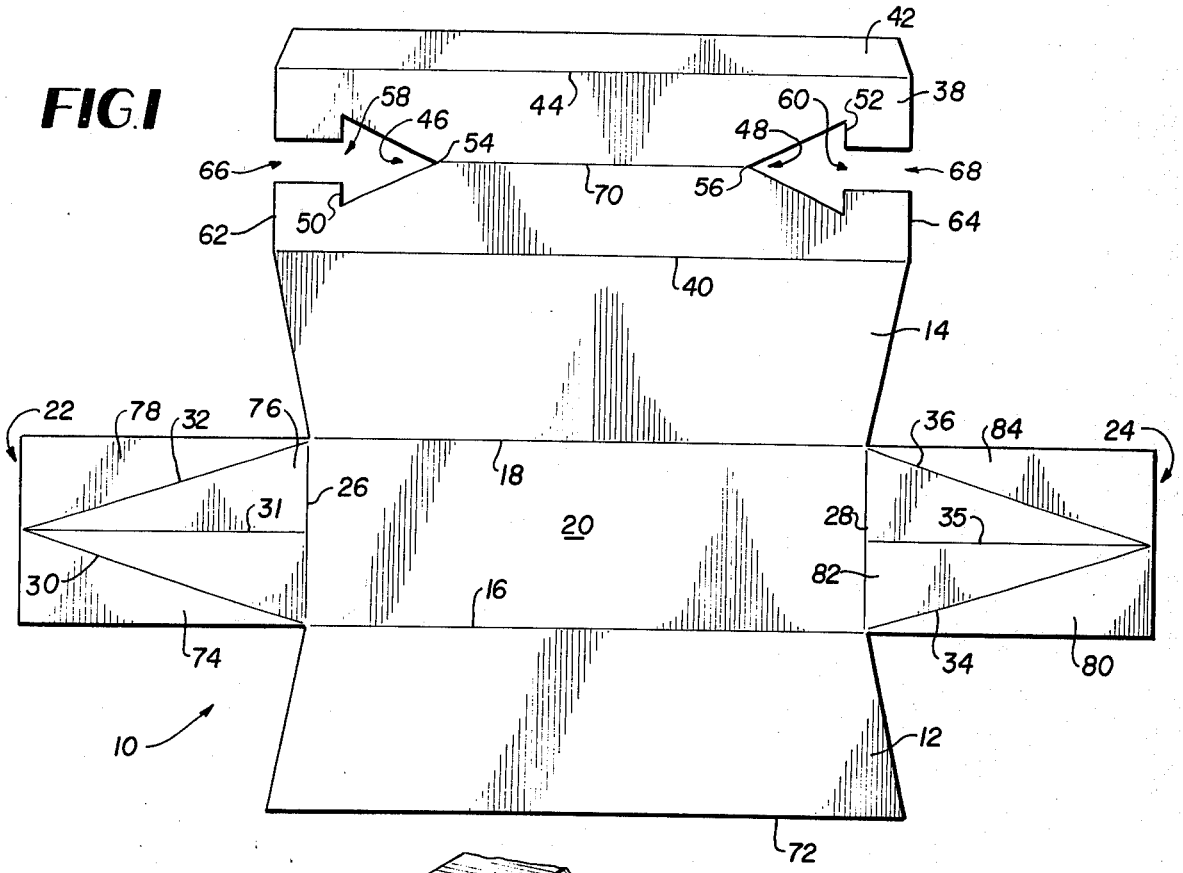
FIG. 2
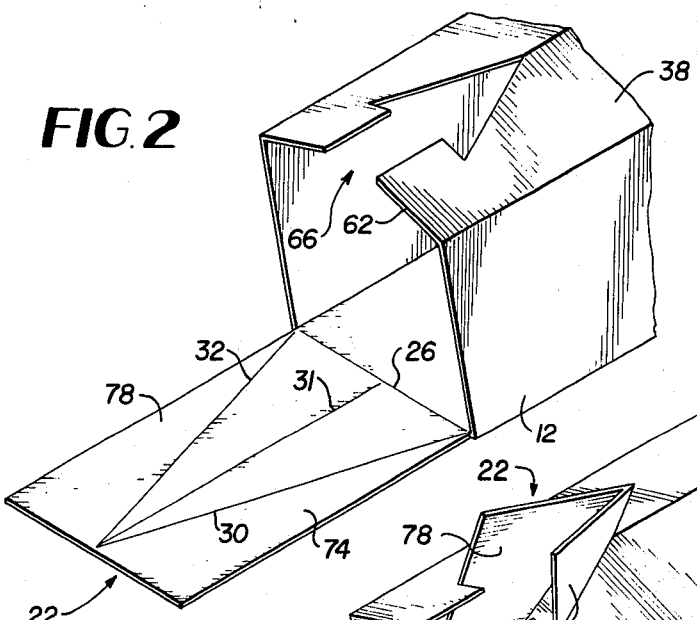
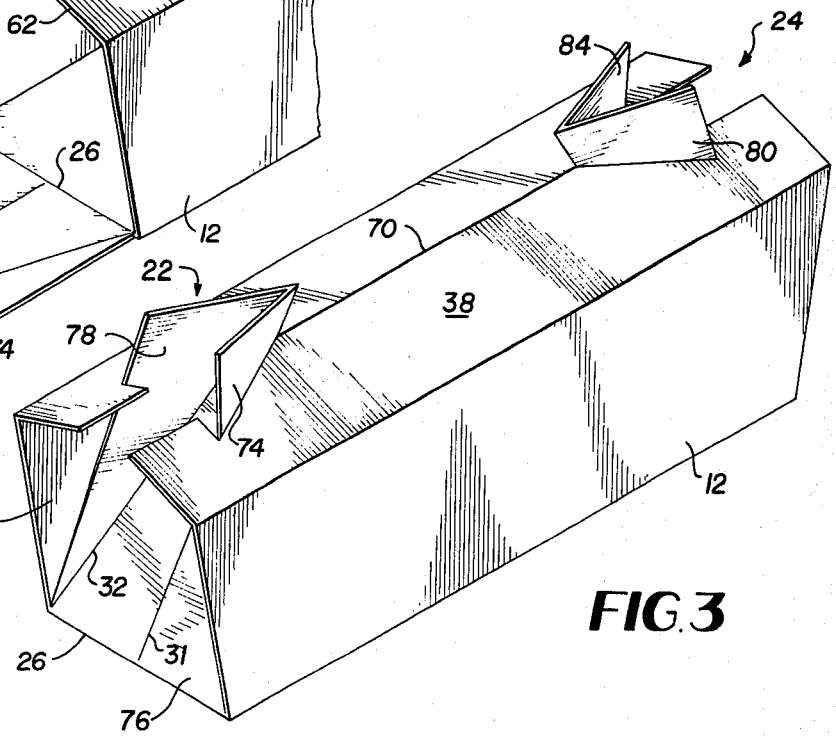
FIG. 3

FIG. 5
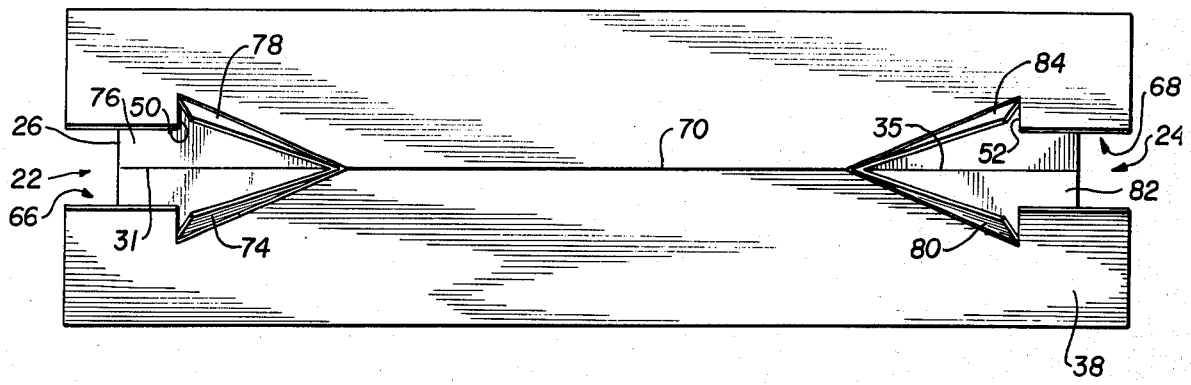
FIG. 4
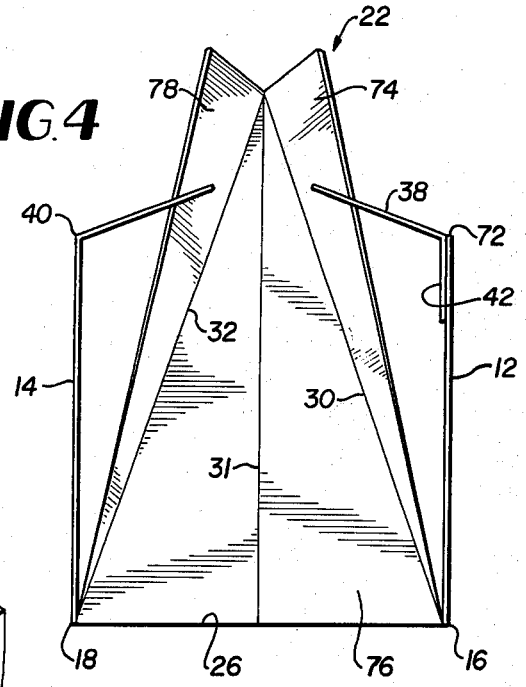
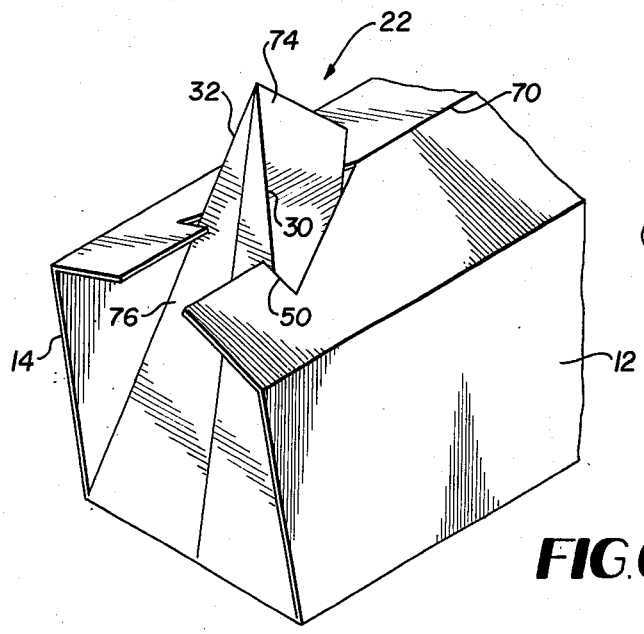
FIG. 6

FOOD CONTAINER

BACKGROUND OF THE INVENTION

1. Field of the Invention

The present invention relates generally to containers and more specifically to a container having readily removable and relockable end panels.

2. Description of the Prior Art

With increased competition in the fast food industry, food is being packaged in distinctive and novel containers instead of the usual paper wrappings. For circular sandwiches, for example hamburgers, an essentially cubed shaped box having entry through the top is generally used. for the non-circular foods, for example hot dog sandwiches and other sandwiches served on long buns, the fast food industry is still packaging these by wrapping them in paper. Prior art fast food containers have also been limited in motif by using cubical or rectangular prism shapes. In these prior art containers, the motif is produces only by the printing on the container. Thus there exists a need in the fast food industry for a container which offers a unique motif for advertising purposes as well as to accommodate fast foods of an elongated shape.

SUMMARY OF THE INVENTION

The present invention is a substantially rectangular cross section, closed container formed from a one-piece blank wherein the end panels are divided by fold lines into three triangles. A pair of triangular slots in the top panel, open at a portion of their base and connected to a respective lateral edge of a top panel by another slot, are provided to removably receive and lock the folded end panels. The top also includes a fold line inter-connecting the vertices of the triangular slots. The fold line of the top panel allows the top panel to emulate the motif of a gabled roof. The end panels may be folded along their fold lines to form an angle substantially coincident with the angle opposite the base of the triangular slot or may be folded to form a planar surface adjacent the base of the triangular slot. The end panels are of greater height than the side panels so that the end panels extend above the top panels through the triangular slots. The side panels may be trapezoidal with the smaller parallel edge being hinged to the top panel. The end panels are hingedly connected to the bottom panel so that the container of the present invention is formed from a single piece blank.

OBJECTS OF THE INVENTION

An object of the present invention is to provide a container for the fast food industry.

Another object is to provide a container having a novel motif emulating a gabled roof house.

A further object of the invention is to provide a novel motif container for elongated fast food items.

Still another object is to provide a container with a reusable lock for the end panels.

A still further object is to provide a container for elongated items which is inexpensive to manufacture and easy to assemble.

Other objects, advantages, and novel features of the present invention will become apparent from the following detailed description of the invention when considered in conjunction with the accompanying drawings.

BRIEF DESCRIPTION OF THE DRAWINGS

FIG. 1 is a plan view of the blank for constructing the container shown in FIGS. 2 through 6;

FIG. 2 is a partial perspective of the assembled container prior to folding and closing the end panel;

FIG. 3 is the perspective view of the preferred embodiment of the container of the subject invention constructed from the blank of FIG. 1;

FIG. 4 is an end view of the container of FIG. 3;

FIG. 5 is a top view of the container of FIG. 3; and

FIG. 6 is a partial perspective view of the container of the present invention constructed from the blank of FIG. 1 and having the end panel folded in an alternate manner.

DESCRIPTION OF THE PREFERRED EMBODIMENTS

A single-piece blank 10, shown in FIG. 1, includes two quadrilateral side panels 12 and 14 connected by fold lines 16, 18 respectively to the bottom panel 20. End panels 22 and 24 are hingedly connected along the flod lines 26 and 28 respectively to the bottom panel 20. Fold lines 30, 32 and 34, 36 on end panels 22 and 24, respectively, divide the panels respectively into three triangular sections. fold lines 31 and 35 in end panels 22 and 24, respectively, substantially bisect the angle formed by fold lines 30, 32 and 34, 36 respectively. A top panel 38 is hingedly connected along fold line 40 to the side panel 14 and an attachment panel 42 is hingedly connected along fold lind 44 to the top panel 38. All of the panels are quadrilateral and panels 12 and 14 may be trapezoidal with the smaller parallel edges 16 and 18 being hinged to the bottom panel 20.

The top panel 38 includes a pair of triangular slots 46 and 48 having bases 50 and 52 and vertices 54 and 56 respectively. The bases 50 and 52 have openings 58 and 60 respectively which are connected to the lateral edges 62 and 64 of the top panel 38 by quadrilateral slots 66 and 68 respectively. A fold line 70 is provided connecting the vertices 54 and 56. The blank 10 may be made from a cardboard stock or other suitable material such as plastics.

The container of the present invention is assembled by securing attachment panel 42 and a portion of side panel 12 adjacent edge 72 together by suitable means, for example, glue. It should be noted that attachment panel 42 may be provided along any of the longitudinal fold lines 16, 18, 40, 44, or 72 and secured by, for example, glue, to the adjacent lateral edge upon folding. The essence of blank 10 is that the top, bottom, and two side panels are to be joined into a substantially rectangular cross-sectional container. At this point of construction the container is opened at both ends, one end of which is illustrated in FIG. 2. This facilitates the insertion of the elongated object, for example, a hot dog and bun, into the container.

Once the contents have been inserted into the container, panels 22, 24 are folded and then locked into place in the triangular openings 46, 48, respectively, provided in the top panel. 38. In the first preferred embodiment, illustrated in FIGS. 3 through 5, the lateral edges of the end panels 22 and 24 are folded along fold lines 30, 32 and 34, 36 (down in FIG. 1) to produce triangular sections 74, 76, 78, and 80, 82, 84, respectively. The angles formed between triangular sections 74 and 78 and 80 and 84 are similar or substantially equal to the angles whose vertices are 54 and 56 of the triangular slots 46 and 48 and opposite bases 50 and 52. By bending triangles 74 and 78 and 80 and 84 toward each other, the total end panel can traverse quadrilateral slot 66 and 68 respectively and spring away from each other so that the angle formed by the triangular section 74, 78 and 80, 84 is coincident with the angle whose vertices are 54 and 56 of the triangular slot. After the triangles have sprung away from each other, the lateral exterior edge of triangular segment 74, 78 and 80, 84 lie and lock against bases 50 and 52 of the triangular slot.

To facilitate the bending of the end panel along the fold lines 30 and 32 and 34 and 36, the additional fold lines 31 and 35 are provided, substantially perpendicular to the fold lines 26 and 28 and bisecting the angle opposite the fold lines 26 and 28. Since this fold line facilitates the folding of the end panel into the three triangular sections as shown in FIGS. 3 through 5, and particularly facilitating the intersection of fold lines 30 and 32, this additional fold line need not traverse the total height of the end panels.

It can be seen that the quadrilateral end panels 22 and 24, having fold lines dividing it into three or four triangular segments, provides end panels which are easily inserted through small quadrilateral channels into substantially triangular slots wherein it is received and locked. The end panels 22 and 24 are easily removed and relocked by grasping triangular segments 74, 78 and 80, 84 between the thumb and index finger and moving them towards each other. The height of the end panels 22 and 24 is greater than the heights of the side panels 12 and 14 such that the end panels protrude above the top panel 38 which allows easy access to the end panels for readily inserting and removing the end panels from the slots.

An alternate folded configuration of the end panels using the preexisting pairs of fold lines 30, 32 and 34, 36 is shown in FIG. 6. Instead of folding along fold lines, for example 30 and 32, to cause triangular segments 74 ad 78 to form an angle therebetween substantially identical or similar to the angle whose vertex is 54, the triangular segments 74 and 78 are folded in a reverse manner along fold lines 30 and 32 (up in FIG. 1) so as to cause triangular segments 76 to form a plane which when inserted through slot 66 lie adjacent to the base 50 of the triangular slot 58. Through the embodiment shown in FIG. 6 uses base 50 of the triangular slot as the locking portion as does FIG. 3 throught 5, the corresponding portion of the end panel in FIG. 6 is the planar triangular segment 76 instead of the lateral exterior edges of triangular segment 74 and 78 as displayed in FIGS. 3 through 5.

Since the planar surface of triangular segment 76 is not flexible, a different method of insertion through slot 66 and into triangular slot 46 must be provided. The width of the triangular segment, 76, by definition, varies with the distance from the vertex. Taking advantage of fold line 70 connecting the vertices 54 and 56 of the triangular slot 46 and 48 respectively, the top panel 38 is folded about fold line 70 so as to increase the height of quadrilateral slot portion 66 to a height sufficient to allow the triangular segment 76 of end panel 22 to pass therethrough. Once the folded end panel 22 passes base 50 and lies in triangular slot 46, the top panel 38 is lowered causing planar triangular segment 76 to lie adjacent to the lock against base 50 of the triangular slot. The locking relationship and the method of insertion of the embodiment illustrated in FIG. 6 is possible because of the triangular shape of planar porion 76 of the end panel 22 and the fold line 70 provided in the top panel 38. Using the embodiment of FIG. 6, the additional fold lines 31 and 35 may be deleted from the end panels 22 and 24.

As can be seen from FIGS. 2 through 6, a container is provided having a decorative motif, for example, a house having a gabled roof, and a self-locking, easily removable end panel. The container disclosed and described is particularly useful in the fast food industry for hot dogs on a bun or other sandwiches provided on an elongated roll or a piece of bread. By providing end panels having a greater height than the height of the side panels, including any additional height provided by the pitch of the gabled roof, the end panels are more easily inserted in and removed from a locking slot than prior art end panels requiring extensive manipulation of parts to tuck and fold the panels into a narrow slit in the box to lock them thereto. It should be noted that additional motif or advertising may be provided on the side panels 12 and 14 as well as the triangular portion 76 and 82 of end panels 22 and 24. A shingle design on top panel 38 may be used to further enhance the gabled roof effect.

From the preceding description of the preferred embodiment, it is evident that the objects of the inventions are attained and, although the invention has been described and illustrated in detail, it is to be clearly understood that the same is by way of illustration example only and is not to be taken by way of limitation. The suggested materials and shapes of the specific panels are by way of illustration only. The top panel 38, which may be comprised of a pair of panels joined at a fold line, for example, 70, is of a greater width than bottom panel 20 so that the distance between side panels 12 and 14 is not substantially decreased when the halves of the top panel are folded about fold line 70. The quadrilateral slots 66 and 68 are illustrated as substantially rectangular but may be any quadrilateral shape having a pair of openings, one at a lateral edge of the top panel 38 and the other at a base of the respective triangular slot. The top or longer longitudinal edge of the trapezoidal side panels may be extended and the length of the top panel increased so that the end panels are substantially vertical when locked in the triangular slot. This would increase the interior length of the container. The spirit and scope of this invention being limited only by the terms of the appending claims.

What is claimed is:

1. A one-piece blank for a container comprising:

a quadrilateral bottom panel, first and second quadrilateral side panels hingedly connected along longitudinal fold lines to said bottom panel, a top panel hingedly connected along a longitudinal fold line to said first side panel, a pair of quadrilateral end panels hingedly connected along lateral fold lines to said bottom panel, each of said end panels include a pair of fold lines dividing the end panel into three triangles, and a pair of means, defining an opening beginning on opposite lateral edges of said top panel, for removably receiving and locking said pair of end panels respectively.

2. The blank of claim 1 wherein said side panels are trapezoidal with the smaller parallel edge being hinged to said bottom panel.

3. The blank of claim 1 wherein said means each comprise a triangular slot open at a portion of its base and connected to said lateral edge of said top panel by a quadrilateral slot.

4. The blank of claim 3 where in said top panel include a fold line connecting the vertices of said triangular slots.

5. The blank of claim 1 wherein height of said end panels are of a greater height than said side panels.

6. The blank of claim 1 including an attachment panel hingedly connected along a longitudinal fold line to said top panel.

7. A container formed from a one-piece blank comprising:

quadrilateral top, bottom, and two side panels joined together along longitudianl edges, a pair of quadrilateral end panels hingedly connected along opposite lateral edges of said bottom panel, each of said end panels include a pair of fold lines dividing the end panel into three triangles, and a pair of means defining a pair of slots in said top panel beginning at opposite lateral edges of said top panel for locking said end panels closed across the ends defined by said top, bottom, and two side panels.

8. The container of claim 7 wherein said means includes a triangular slot open at a portion of its base and connected to said lateral edge of said top panel by a quadrilateral slot.

9. The container of claim 8 wherein said end panels are folded along their pair of fold lines to form an angle substantially coincident with the angle opposite said base of said triangular slot.

10. The container of claim 9 wherein each of said end panels include an additional fold line, substantially bisecting an angle formed by the pair of fold lines of said end panel.

11. The container of claim 8 wherein said top panel includes a fold line connecting the vertices of said triangular slots and wherein said end panels are folded along their pair of fold lines to form a planar surface adjacent said base of said triangular slot.

12. The container of claim 8 wherein the height of said end panels is greater than the height of said side panels so that said end panels extend above said top panel through said triangular slot.

13. The container of claim 8 wherein said side panels are trapezoidal with the smaller parallel edge being hinged to said bottom panel.

* * * * *